United States Patent [19]

Avison

[11] 4,385,847

[45] May 31, 1983

[54] DAISY WHEEL PRINTER

[75] Inventor: Gerald Avison, Cambridge, England

[73] Assignee: Spiralux Limited, Kent, England

[21] Appl. No.: 279,761

[22] Filed: Jul. 2, 1981

[30] Foreign Application Priority Data

Jul. 9, 1980 [GB] United Kingdom ..... 8022460

[51] Int. Cl.[3] ..... B41J 1/30

[52] U.S. Cl. ..... 400/144.2; 400/174

[58] Field of Search ..... 400/144.2, 144.3, 174, 400/175; 101/43.17–93.19

[56] References Cited

U.S. PATENT DOCUMENTS 3,651,916 3/1972 Becchi ..... 400/144.3

4,018,639 4/1977 Staples ..... 400/144.2 X

FOREIGN PATENT DOCUMENTS 2545311 4/1976 Fed. Rep. of Germany ... 400/144.2

OTHER PUBLICATIONS

Xerox, *Disc. Bulletin*, by Mario G. Plaza, vol. 4, No. 3, May/Jun. 1979, pp. 413–414.

*Primary Examiner*—Paul T. Sewell

*Attorney, Agent, or Firm*—Oblon, Fisher, Spivak, McClelland & Maier

[57] ABSTRACT

A daisy wheel printer having a daisy wheel (10) with a central disc portion (12) and character stalks (14), wherein a masking disc (20) is attached coaxially to the daisy wheel, the mask being larger than the central disc portion of the wheel so that it obscures the daisy wheel stalks in a radial zone of the wheel inwardly of the character petals (16). The mask (20) is provided with a single slit (26) over the interstice between a unique pair of character stalks (14A, 14B), to thereby define a unique datum or home location on the daisy wheel. This datum slit is detected by means of a light source (28) and light-sensitive detector (30) which emits a pulse each time the datum slit passes through a light beam directed towards the detector at the radial zone of the daisy wheel whereat the datum slit is provided. The invention provides a datum slit enabling optical detection of a datum location on the daisy wheel without in any way affecting the performance of the daisy wheel for printing and, in particular, without affecting the flexibility of the character stalks.

5 Claims, 2 Drawing Figures

DAISY WHEEL PRINTER

BACKGROUND OF THE INVENTION

1. Field of the Invention

This invention relates generally to a printer, and more specifically to a printer having a printing head incorporating a daisy wheel having a central disc portion and a plurality of character stalks radiating therefrom. The invention also concerns the daisy wheel per se.

2. Description of the Prior Art

In a daisy wheel printer, it is necessary, in accordance with character selection by a keyboard, computer or other character selecting means, to move the selected character to an operative position for imprinting of said character by an impacting mechanism such as a hammer. For this purpose the position of the daisy wheel as it rotates must be precisely monitored. One convenient and inexpensive means for providing positional information is to observe the stalks of the daisy wheel, as the latter rotates, with a non-contacting sensor. This sensor produces pulses representing quanitized positional information as to the rotational position of the daisy wheel. However, this sensor only gives relative information about the rotation of the daisy wheel. In order to gain absolute positional information, i.e. to know exactly where any character is and thereby by how much the wheel must be rotated, it is necessary to provide a datum from which to count the pulses produced by the stalk-observing sensor.

SUMMARY OF THE INVENTION

It is an object of this invention to provide a convenient and inexpensive device for defining and detecting a datum location on a daisy wheel.

According to the invention, there is provided a printer firstly having a printing head incorporating a daisy wheel with a central disc portion and a plurality of character stalks radiating from said central disc and secondly having a device for detecting a datum position of the daisy wheel, wherein said datum position detector comprises a mask carried by the disc portion of the daisy wheel and having a peripheral portion which covers a radial zone of the daisy wheel traversed by the character stalks, said peripheral portion having an aperture to expose at said radial zone only the interstice between a unique pair of character stalks, the detector also including a light source and a light sensitive sensor responsive to an interrupted light beam from the source which is incident on the peripheral portion of the mask.

By way of explanation, it should be understood that it is preferable to locate a datum slit for optical detection as close as possible to the periphery of the daisy wheel, since this will maximise the amount of light transmitted through a slit of given angular aperture, i.e. a wider slit can be employed nearer the periphery of the wheel. However, close to the periphery, the wheel is already interrupted by the discrete nature of the stalks, and if these stalks are also allowed to interrupt the light beam, there is risk of ambiguity in the datum position. The invention provides a solution to this problem without requiring any additional interconnection of the stalks which would reduce their bending stiffness.

Preferably, the disc portion of the daisy wheel is provided with locating spigots and the mask is provided at an inner region thereof with locating holes for location on said spigots. The mask is best carried by the face of the daisy wheel facing away from the direction of flexing of the character stalks during printing.

When the invention is employed to define and detect the datum position, it is convenient to employ optical means to provide the relative positional information used to monitor rotation of the daisy wheel in accordance with character selection. Preferably, therefore, the rotational position of the daisy wheel relative to the datum is sensed by a second light-sensitive sensor responsive to the interrupting action of the character stalks on a light beam which is incident on a second radial zone of the daisy wheel radially outside said first-mentioned radial zone. Thus, in a preferred arrangement, the second radial zone is immediately adjacent said first radial zone, and a common light source is employed for directing light on to both said zones, the first sensor being responsive only to light received through the datum aperture in the mask at the first radial zone and the second sensor being responsive only to light received past the stalks at said second radial zone.

The mask may be made of opaque plastics sheet material.

The invention also concerns the above-described daisy wheel per se, i.e. a daisy wheel for printing having a central disc portion and a plurality of character stalks radiating therefrom, and a mask carried by the disc portion of the daisy wheel and having a peripheral portion which covers a radial zone of the daisy wheel traversed by the character stalks, said peripheral portion having an aperture to expose at said radial zone only the interstice between a unique pair of character stalks.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
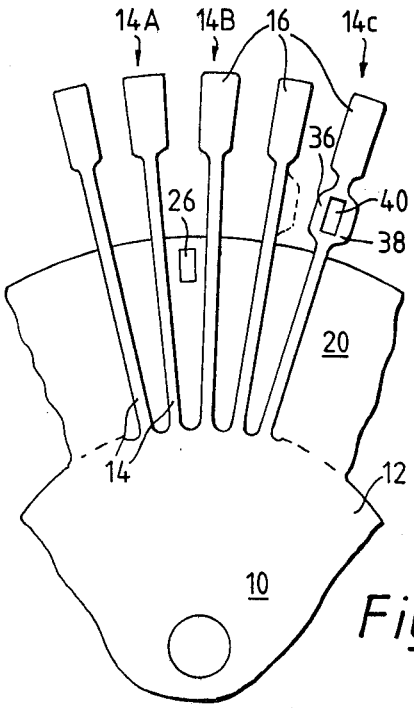
FIG. 1 is a partial view of one face of a daisy wheel.
Figure 2:
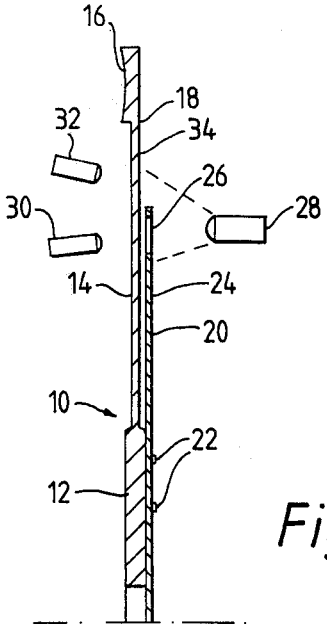
FIG. 2 is a view of the daisy wheel in radial section, together with an optical sensing means.

FIGS. 1 and 2 show a daisy wheel 10 having a central disc portion 12 and radial stalks 14 projecting from said disc portion with character petals 16 at their ends.

Mounted to one face of the daisy wheel 10, namely the face 18 directed away from the direction in which the stalks 14 flex during printing, is a masking disc 20, conveniently made of opaque plastics material. The central disc portion 12 of the daisy wheel 10 has spigots 22 on which the inner region of the mask 20 locates by means of corresponding holes therein. The peripheral portion 24 of the mask 20 projects outwardly beyond the central portion 12 of the wheel 10 into a radial zone traversed by the stalks 14. Such mask peripheral portion 24 is provided with a single slit-like aperture 26, positioned between a unique pair of stalks 14A, 14B. At this radial zone of the daisy wheel 10, the mask 20 therefore obscures all the stalks 14 of the daisy wheel and the interstices therebetween except for the one interstice between said stalks 14A, 14B. The aperture slit 26 thus defines a unique datum or home position on the daisy wheel 10.

This datum slit 26 can be detected by an optical sensing means comprising a light emitter 28 and a photoelectric detector 30, respectively disposed on opposite sides of the peripheral region 24 of the mask 20, in the radial zone of the datum slit 26. The detector 30 will produce a datum pulse when the datum slit passes through the light beam from the source 28 during rotation of the daisy wheel.

The drawing also shows that relative positional information about the rotation of the daisy wheel can be obtained using the same light emitter 28 and a second light sensitive detector 32. The emitter 28 is arranged also to direct a light beam through the radial zone 34 of the daisy wheel 10 immediately outside the periphery of the mask 20. This light beam is interrupted by the moving stalks 14 of the daisy wheel 10 during rotation of the latter, whereby the detector 32 produces a train of pulses representing quantized information as to the position of the daisy wheel relative to the datum, i.e. by counting the pulses of said train relative to the datum pulse.

The resolution of the pulse train produced by the sensor 32 can be increased, as indicated for the stalk 14C in FIG. 1, by splitting the stalks 14 of the daisy wheel 10 in the region of the outer radial zone 34. The two distinct branches 36 and 38 of each stalk at said radial zone 34, separated by an aperture 40, double the frequency of the pulses in the pulse train, thereby ensuring that the relative positional information is wholly unambiguous. The resolution can be further increased by sub-dividing the stalks into the three or more branches. In all cases, the stalks are preferably subdivided so that the apertures between the branches have a width equal to the spacing between the stalks at said radial zone 34.

The daisy wheel 10, rotated by a stepper motor or the like, preferably operating unidirectionally, will be controlled by a microcomputer, utilizing the information obtained from the datum sensor and from the relative position sensor, to start and stop rotation of the daisy wheel in accordance with character selection, which may be effected by a keyboard in the case of a typewriter or by a computer in the case of information transmission. The invention is especially aimed at a low cost typewriter, such as a toy typewriter, and in such circumstances is capable of providing for definition and detection of a datum or home position of a daisy wheel at relatively low cost.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A printer having a printing head incorporating a daisy wheel having a central disc portion and a plurality of character stalks radiating from said central disc and having a device for detecting a datum position of the daisy wheel, wherein said datum position detector comprises a mask carried by the disc portion of the daisy wheel having a peripheral portion which covers a radial zone of the daisy wheel transversed by the character stalks, said peripheral portion having an aperture to expose at said radial zone only the interstice between a unique pair of character stalks, the detector also including a light source and a light sensitive sensor responsive to an interrupted light beam from the source which is incident on the peripheral portion of the mask, and further wherein the rotational position of the daisy wheel relative to the datum is sensed by a second light sensitive sensor responsive to the interrupting action of the character stalks on a light beam which is incident on a second radial zone of the daisy wheel radially outside said first radial zone and wherein said second radial zone is immediately adjacent said first radial zone, and a common light source is employed for directing light onto both said zones, the first sensor being responsive only to light received through the datum aperture in the mask at the first radial zone and the second sensor being responsive only to light received past the stalks at said second radial zone.

2. A printer according to claim 1 wherein the disc portion of the daisy wheel is provided with locating spigots and the mask is provided at an inner region thereof with locating holes for locating said spigots.

3. A printer according to claim 1 wherein the mask is carried by the face of the daisy wheel facing away from the direction of flexing of the character stalks during printing.

4. A printer according to claim 2 wherein the mask is carried by the face of the daisy wheel facing away from the direction of flexing of the character stalks during printing.

5. A printer according to claim 1 wherein the mask is made of opaque plastic sheet material.

* * * * *